United States Patent [19]

Roehl

[11] 4,341,567

[45] Jul. 27, 1982

[54] METHOD OF VAPOR DEGREASING

[75] Inventor: Ernest O. Roehl, Huntington Beach, Calif.

[73] Assignee: Rho-Chem Corporation, Inglewood, Calif.

[21] Appl. No.: 257,578

[22] Filed: May 7, 1981

Related U.S. Application Data

[63] Continuation-in-part of Ser. No. 163,988, Jun. 30, 1980, Pat. No. 4,289,542.

[51] Int. Cl.[3] ..... B08B 5/00

[52] U.S. Cl. ..... 134/11; 134/31; 134/40; 570/121; 570/122

[58] Field of Search ..... 134/11, 31, 40; 570/121, 122; 252/172, 364, 399, DIG. 9

[56] References Cited

U.S. PATENT DOCUMENTS

| | | | |
|---|---|---|---|
| 1,948,045 | 2/1934 | Parkhurst | 252/172 |
| 2,070,962 | 2/1937 | Reid | 252/172 |
| 3,274,700 | 9/1966 | Maguire et al. | 134/11 X |
| 4,046,820 | 9/1977 | Goodner et al. | 570/121 |

FOREIGN PATENT DOCUMENTS 2440391 5/1980 France .

OTHER PUBLICATIONS

*Chemical Abstracts,* vol. 69, 1968, Abstract No. 78540v, p. 7363.

*Primary Examiner*—Marc L. Caroff
*Attorney, Agent, or Firm*—Cislo, O'Reilly & Thomas

[57] ABSTRACT

A contaminated article is subjected to vapor degreasing operations wherein the vapor degreasing solvent is a blend consisting essentially of methylene chloride and either 1,1,1-trichloroethane or trichloroethylene. Addition of methylene chloride to the solvent blend is found to stabilize the other component of the blend in the presence of contaminants encountered in the conventional vapor degreasing process; thus extending the normal life of the degreasing solvents.

14 Claims, No Drawings

METHOD OF VAPOR DEGREASING

REFERENCE TO RELATED APPLICATION

This application is a continuation-in part application of application Ser. No. 06/163,988 entitled METHOD OF VAPOR DEGREASING filed June 30, 1980, now U.S. Pat. No. 4,289,542, having the same applicant as herein.

BACKGROUND OF THE INVENTION

With the advent of OPEC, and the high cost and short supply of hydrocarbons, alternatives for existing vapor degreasing solvents has intensified.

The ordinary vapor degreasing solvents are normally chlorinated hydrocarbon ones, which meet the criteria of having no flash point and possessing good contaminant solvency and resusability through reclamation processes.

The prior art has utilized, as the basic vapor degreasing solvent, 1, 1, 1 trichloroethane or trichlorethylene for use in the ubiquitous vapor degreasing machine and operation. These solvents are ordinarily used in conjunction with a stabilizer which will extend the useful life of the vapor degreasing solvent.

In the vapor degreasing process, a non-flammable solvent is boiled to produce a vapor zone, the height of which is controlled by condensing coils. Cold work is introduced into the vapor, causes vapor condensation thereon, and the contaminant carried on the cold work, usually oil, grease or flux, is flushed off by the liquid solvent condensate. The contaminant, along with the condensate, is returned to the boiling sump of the vapor degreasing machine. This condensate, or distillate, then is revaporized to repeat the cycle of cleansing through condensation.

The work piece which is to be cleansed is held in the vapor zone until the temperature thereof reaches the vapor temperature within the vapor zone, at which time condensation stops. Vapor flushing is usually followed by pure distillate spray and/or liquid immersion. The cool, pure distillate reduces the temperature of the metal surface below the vapor temperature producing a second vapor condensation. When the work piece again reaches vapor temperature, it is withdrawn from the vapor zone, clean and dry.

The vapor degreasing solvent is used at its boiling point in order to produce the vapor zone necessary for vapor condensation and resultant cleaning.

Where 1, 1, 1 trichloroethane or trichlorethylene either alone or in conjunction with certain stabilizers to prolong the life thereof are utilized, serious drawbacks occur.

That is, during the degreasing operations, the degreasing solvent is adversely affected by the increasing amounts of contaminants finding their way into the boiling sump in that the boiling temperature of the solvent in the sump increases as the amount of contaminant increases. To compensate for this added contamination, solvent manufacturers add acid inhibitors or stabilizers in an effort to extend its vapor degreasing life.

When the temperature in the boiling sump of the vapor degreasing device reaches and exceeds a designated temperature range, normally signifying extensive contamination, depletion of the stabilizers is nearly complete and additional usage of the solvent is not recommended because of acidic breakdown and failure.

For 1, 1, 1 trichloroethane this range is about 172°–174° F. whereas for trichlorethylene it is 195°–198° F.

Vapor degreasing handbooks recommend that vapor degreasers be shut down and the degreasing operation terminated to allow clean-out of the boiling sump once the boiling sump temperatures reach about 172° F. for 1, 1, 1 trichloroethane and 195° F. for trichlorethylene. The general criteria, measured in other terms for solvent rejuvenation, are when the boil sump specific gravity is between 1.21 and 1.33 or has an acid acceptance value of about 0.03–0.06, or wherein the pH value is between about 5.5–6.0.

In order to extend the life of the solvent by as much as 50%, and to reduce the boiling sump temperature, even with contamination present, and to provide a satisfactory vapor degreasing solvent of lower overall cost, it has been found that the addition of methylene chloride to 1, 1, 1 trichloroethane or trichlorethylene in an amount to reduce the initial boiling temperature of the resultant blend to about 110° F. to 190° F. achieves definite attributes, while alleviating many of the detriments found in prior art uses and methods of vapor degreasing using other solvents alone or with stabilizers to extend its useful life.

In the United States, environment protection regulations (EPA) dictate that a degreasing solvent may not contain more than 20% by volume of trichlorethylene. Thus, a solvent blend in accordance with this invention of about 20–10 volume percent of trichlorethylene and 80–90 volume percent methylene chloride is efficacious and better than trichlorethylene alone or methylene chloride alone.

In the conventional vapor degreasing process, there ideally exists about a 45°–50° F. temperature differential between the temperature of the inlet cooling water and the temperature of the degreasing vapors. Thus, where refrigerated or cooler temperatures are made available, a solvent blend of the invention using higher methylene chloride proportions may be utilized. In such cases, a preferred percentage of methylene chloride in the blends of the invention will be about 70–90 volume percent disregarding environmental regulations.

The lower boiling point of the resultant blends of the invention not only extends solvent life, but also lowers energy or heating requirements since the boiling point temperatures of the vapor degreasing solvents of the invention are lowered.

OBJECTS AND SUMMARY OF THE INVENTION

It is an object of the invention to provide a vapor degreasing solvent of advantageous characteristics.

It is another even further object of the invention to provide a vapor degreasing solvent comprising a solvent blend of 1, 1, 1 trichloroethane and methylene chloride wherein the initial boiling temperature thereof is about 135° F.

It is still another even further, more specific object of the invention to provide a vapor degreasing solvent of 1, 1, 1 trichloroethane and methylene chloride wherein the 1, 1, 1 trichloroethane comprises about 65 volume percent of the solvent mixture.

It is another even further, more specific important object of the invention to provide a method of conducting vapor degreasing operations utilizing the vapor degreasing solvent of the invention.

It is another even further, more specific object of the invention to provide a vapor degreasing operation wherein a 1, 1, 1 trichloroethane-methylene chloride solvent blend is utilized where the vapor degreasing operation is conducted in reflux and recycling conditions and wherein the life of the vapor degreasing solvent blend is substantially extended.

It is another even further, even more specific object of the invention to provide a vapor degreasing method and operation wherein the solvent blend used in said method of operation has a lower initial boiling point, and thus is capable of satisfactorily operating in a vapor degreasing environment over longer periods of time.

It is another even more and further specific object of the invention to provide a vapor degreasing method involving the creation of a solvent boiling zone wherein solvent introduced therein is a blend of 1, 1, 1 trichloroethane and methylene chloride and wherein contaminants and condensed vapor are returned to the boiling zone and wherein vapor degreasing operations are continuously carried out until such point as the temperature in the boiling zone reaches about 172° F.

It is still an even more important and further specific object of the invention to provide a vapor degreasing method of operation utilizing a vapor degreasing solvent comprising 65 volume percent of 1, 1, 1 trichloroethane and 35 volume percent methylene chloride wherein the initial temperature of the resultant solvent blend is approximately 135° F. and continuing the degreasing operation by the addition of amounts of additional solvent blend of 1, 1, 1 trichloroethane and methylene chloride and continuing the vapor degreasing operation until the temperature of the contaminated solvent blend in the boiling sump of the vapor degreasing apparatus approximates 172° F., thereafter discontinuing the vapor degreasing operation and reclaiming 1, 1, 1 trichloroethane-methylene operations.

In an exemplary embodiment, the invention is directed to the method of vapor degreasing, using a solvent consisiting essentially of 1, 1, 1 trichloroethane wherein the improvement comprises adding a sufficient amount of methylene chloride to reduce the initial boiling point of the resultant solvent blend to about 135° F. and thereafter conducting vapor degreasing operations with the solvent blend at reflux temperatures and removing contaminants with said solvent, until the temperature of the contaminated solvent blend reaches about 172° F.

It is another even further object of the invention to provide a vapor degreasing solvent comprising a solvent blend of trichlorethylene and methylene chloride wherein the initial boiling temperature thereof is about 120° F.

It is still another even further, more specific object of the invention to provide a vapor degreasing solvent of trichlorethylene and methylene chloride wherein the trichlorethylene comprises about 10 volume percent of the solvent mixture.

It is another even further, more specific object of the invention to provide a vapor degreasing operation wherein a trichlorethylene-methylene chloride solvent blend is utilized where the vapor degreasing operation is conducted in reflux and recycling conditions and wherein the life of the vapor degreasing solvent blend is substantially extended.

It is another even more and further specific object of the invention to provide a vapor degreasing method involving the creation of a solvent boiling zone wherein solvent introduced therein is a blend of trichlorethylene and methylene chloride wherein contaminants and condensed vapor and returned to the boiling zone and wherein vapor degreasing operations are continuously carried out until such point as the temperature in the boiling zone reaches up to about 195° F., depending on the blend used.

It is still an even more important and further specific object of the invention to provide a conventional vapor degreasing method of operation utilizing a vapor degreasing solvent comprising 50 volume percent of trichlorethylene and 50 volume percent methylene chloride wherein the initial boiling temperature of the resultant solvent blend is approximately 141° F. and continuing the degreasing operation by the addition of amounts of additional solvent blend of trichlorethylene and methylene chloride and continuing the vapor degreasing operation until the temperature of the contaminated solvent blend in the boiling sump of the vapor degreasing apparatus approximates 161° F., thereafter discontinuing the vapor degreasing operation and reclaiming trichlorethylene-methylene chloride solvent for reuse in vapor degreasing operations.

In another exemplary embodiment, the invention is directed to the method of vapor degreasing, using solvent blends on the invention having selected amounts of methylene chloride to reduce the initial boiling point of the resultant solvent blend, thereafter conducting vapor degreasing operations with the solvent blend at reflux temperatures and removing contaminants with said solvent, until the temperature of the contaminated solvent blend reaches a preselected value depending on the initial solvent used and the vapor degreasing apparatus with which the solvent is used.

These and other objects of the invention will become apparent from the herein after following commentary.

DESCRIPTION OF THE BEST EMBODIMENTS CONTEMPLATED

In the conventional vapor degreasing apparatus, a boiling chamber or sump contains a heating element thereby forming a boiling zone. Positioned above the boiling zone is a vapor condensation zone wherein condensing coils and cooling jacket may be employed to condense vapors therein. In operation on a straight vapor cycle, the work piece to be cleaned is lowered into the vapor zone and is washed by solvent vapors which condense on the work piece surface. The resulting condensate flows from the surface of the work piece together with the contaminants and drips back into the boiling solvent contained in the boiling chamber or boiling sump.

When the work piece temperature reaches that of the vapors in the vapor zone, condensation and cleaning action ceases. In some instances, vapor losses of the solvent contained in the boiling chamber or boiling sump are maintained at the operational level by addition of solvent, and by the continuous return of the condensate from the work piece being cleaned, which, of course, will also take with it into the boiling sump or boiling chamber, contaminants comprising oil, grease and the like.

In this type of vapor degreasing apparatus, which is of the conventional type, vapor degreasing may continue until such time as adversely high temperatures result in the boiling sump or boiling zone. This is for the reason that, while the initial boiling point of the boiling sump or boiling zone may be that of the degreasing solvent being used, vapor degreasing action may only continue until such time as the contaminants in the boiling sump or boiling zone raise the temperature to certain points depending on solvent mixtures and as will be seen hereinafter, at which time breakdown and failure of the solvent may result. When this occurs, the vapor degreasing operation must be shut down, and the boiling sump cleaned out, and the vapor degreasing solvent replaced or subjected to a reclamation process, in order to remove the contaminants therefrom.

A necessary property of a vapor degreasing solvent is its ability to be reclaimed, that is, to be subjected to a process that separates the solvent from the solvent-contaminant mixture so that the solvent may be used again. That process which is used throughout the vapor degreasing industry is distillation. The solvent blends of the invention may be reclaimed, or distilled for re-use.

In the normal course of vapor degreaser operation, the solvent condensate is returned to the boiling solvent-contaminant mixture in the boil sump. A vapor degreaser is commonly designed by the vapor degreaser manufacturer to also function as a solvent recovery still. To function as a solvent recovery still, designated valves are opened and/or closed to cause the solvent condensate to be directed to solvent storage tanks or to drum storage instead of being returned to the boil sump. The solvent is thus separated from the solvent-contaminant mixture and, following removal of the residual contaminant from the boil sump of the vapor degreaser, the solvent may be transferred back into the vapor degreaser for re-use.

A second and less frequently used procedure for the distillation of vapor degreasing solvents is the use of a separate still.

Conventionally, a simple one-plate still, such as commonly found and as those of ordinary skill in the vapor degreasing art are familar, will do a satisfactory job of reclaiming chlorinated solvents. Such units may be operated on a batch basis or can be coupled directly to the degreaser and operated continuously. With the latter arrangement, contaminated solvent is pumped directly to the still from the degreaser. Solvent level in the still is maintained by an automatic level control which actuates a solvent transfer pump. This affords maximum cleaning efficiency in the degreaser while minimizing shut-down time to clean the unit and refill with fresh solvent. Many solvent recovery stills use live steam injection to maximize efficiency.

Thus, by usual and conventional distillation, the solvent blends of the invention are recovered for reuse in the practice of the invention.

By the addition of methylene chloride in about the range of about 0.1 volume percent to 90.0 volume percent to 1, 1, 1 trichloroethane or trichlorethylene, a blended solvent is obtained which has a lower initial boiling point than 1, 1, 1 trichloroethane or trichlorethylene alone. The solvent blend comprising the 1, 1, 1 trichloroethane and methylene chloride or trichlorethylene and methylene chloride provides a constant boiling point solvent exhibiting stable operating characteristics in a vapor degreaser. The theory which would appear to explain the lack of fractionation of the two disparate solvents, making up the solvent blends of the invention, would appear to be as a result of Raoult's Law.

In accordance with Raoult's Law, groups of similar solvents are classified in specific classes and in accordance with theory, a solvent blend of two or more components of the same class of solvents will operate in a state of total reflux (applied to vapor degreasing where the blend is boiled, vapors condensed, and condensate returned to boiling sump) and equilibrium will result wherein the temperatures and compositions of both the vapor phase and the boiling liquid phase are constant.

In order to comply with the criteria of the application of Raoult's Law, in the operation of the instant invention, minor losses of vapor and condensate in the vapor degreasing operation are replaced through daily solvent make-up with solvent comprising the solvent blends of 1, 1, 1 trichloroethane and methylene chloride or trichlorethylene and methylene chloride.

In order to ascertain the functionability of the application of the theory behind the solvent blend as being applicable to the practice of the invention, a commercially available grade of 1, 1, 1 trichloroethane was refluxed with different volumes of oil until acid breakdown of the solvent occurred. The length of time which it took for the 1, 1, 1 trichloroethane to reach the breakdown point was recorded in each instance. Thereafter, a solvent blend of 1, 1, 1 trichloroethane and methylene chloride, in accordance with the volume percentages set forth hereinabove, was similarly tested under the same conditions.

It was found that the 1, 1, 1 trichloroethane-methylene chloride solvent blend had an extended life and the initial boiling point of the solvent blend was lower than that of 1, 1, 1 trichloroethane alone. In conducting the tests, a neutral mineral oil is used in varying amounts to provide different boiling temperatures in the boiling zone or boiling sump to determine acid deterioration of the solvent. Each of the solvents and solvent/oil blends was boiled at total reflux for a number of days. That is, 500 milliliter flasks were connected to condensing columns measuring 400 millimeters in jacket length. These were, in turn, connected to water sources by $\frac{5}{8}$ inch tubing to continuously cool the columns. For maintained heating, the flasks and solvent solutions were placed on a 12 inch square hotplate.

During the test periods and at selected intervals, each of the samples was tested for acidic deterioration by determining its acid acceptance value in accordance with A.S.T.M. procedure D-2942. In this test method, a known amount of standard hydrochlorination reagent is used and % acid acceptance value is calculated following titration with 0.1 N NaOH. The acid acceptance value of virgin vapor degreasing grade 1, 1, 1 trichloroethane is in the range of 0.10 to 0.20%. The acid acceptance determinations use 10 and 25 millimeter volumetric pipettes to transfer the solutions into 400 millimeter beakers. The pH of the solution during the tests was checked further using a digital pH meter in conjunction with a stirring rod and magnetic stirrer in order to obtain a homogeneous mixture.

Solvent manufacturers usually recommend that 1, 1, 1 trichloroethane be cleaned out from the vapor degreaser when the acid acceptance value drops to the range of about 0.03% to 0.06% which correlates with oil contamination of about 25% to 30%. In the tests, the solvents were refluxed beyond the recommended clean out values to total acidic decomposition to determine maximum life of the solvent.

These tests are tabulated in the following Table I.

TABLE I

| Sample | Oil, % Volume | Boil Temp. | Hours of Refluxing Before Acidic Failure |
|---|---|---|---|
| Run 1 | | | |

TABLE I-continued

| Sample | Oil, % Volume | Boil Temp. | Hours of Refluxing Before Acidic Failure |
|---|---|---|---|
| 1,1,1 trichloroethane | 0 | 165° F. | 3288* |
| Blend, 1,1,1 trichloroethane/methylene chloride | 0 | 138° F. | 3288* |
| Run 2 | | | |
| 1,1,1 trichloroethane | 25% | 172° F. | 1704 |
| Blend, 1,1,1 trichloroethane/methylene chloride | 25% | 143° F. | 2208 |
| Run 3 | | | |
| 1,1,1 trichloroethane | 50% | 182° F. | 528 |
| Blend, 1,1,1 trichloroethane/methylene chloride | 50% | 150° F. | 864 |

*Test discontinued at this time. Acid acceptance values of the two samples showed no significant difference and were both in the 0.06 to 0.07% which is the safe operating range recommended by solvent manufacturers.

From the foregoing, it will be noted that the addition of methylene chloride to 1, 1, 1 trichloroethane without oil contaminant does nothing more than lower the initial boiling temperature as compared to 1, 1, 1 trichloroethane alone. However, upon the addition of oil and the like contaminants as would be found in the conventional vapor degreasing environment, the addition of methylene chloride not only has an effect on the initial boiling point or temperature of the solvent, but also upon its useful life.

That is, the addition of methylene chloride, as, for example, in test 2 extended the useful life of the solvent by as much as 30% before acidic breakdown, as compared with 1, 1, 1 trichloroethane alone. As contamination grew to 50%, as represented by run 3, solvent life was extended 64% as compared to 1, 1, 1 trichloroethane alone.

In order to further prove the applicability of the solvent blend in vapor degreasing operations, another series of runs was conducted, utilizing commercially available chlorinated hydrocarbon vapor degreasing solvents, namely, 1, 1, 1 trichloroethane and one of the solvent blends of the invention i.e., 1, 1, 1 trichloroethane-methylene chloride. Each of the solvents was boiled at total reflux in the presence of the types of contaminants usually found in typical industrial vapor degreasing applications including measured amounts of aluminum and iron metal fines with heavy duty machine oil. At spaced intervals, each of the solvents was tested for acidic deterioration similar to that testing procedure as set forth for the runs tabulated in Table I.

The results of the test runs are tabulated in Table II hereinafter following, wherein the first three runs employed commercially available 1, 1, 1 trichloroethane, whereas the fourth run employed the 1, 1, 1 trichloroethane-methylene chloride blend comprising 65 volume percent 1, 1, 1 trichloroethane and 35 volume percent methylene chloride.

As noted each of the runs 1–3, inclusive, utilized a commercially available 1, 1, 1 trichloroethane industrial solvent specifically designated for vapor degreasing. Thus, each of samples (1–3) compared to the solvent blend (4) of the invention as follows:

TABLE II

| Manufacturing Source | 25% Oil | 40% Oil | 50% Oil |
|---|---|---|---|
| Run 1 | | | |
| Vulcan Mat'ls Co. Inc. | 888 | 648 | 96 |
| Run 2 | | | |
| PPG Corp. | 888 | 816 | 192 |
| Run 3 | | | |
| Dow Chemical Co. | 840 | 504 | 144 |
| Run 4 | | | |
| 1,1,1 trichloroethane/methylene chloride blend | 1608 | 1056 | 1008 |

Table II illustrates the longevity of the 1, 1, 1 trichloroethane-methylene chloride solvent blend of the invention in terms of both hours of effective use under various levels of oil contamination.

Another series of tests were conducted using acid acceptance values (ASTM Procedure D-2942) to determine solvent longevity using conventional degreasing solvents alone and the solvent blends of the invention. This data is tabulated in Table III, following:

TABLE III

| SOLVENT OR SOLVENT BLEND | HOURS OF OPERATION 400 800 1200 1600 |
|---|---|
| SOLVENT with 25% OIL (Vol.) PLUS WATER, ALUMINUM AND IRON FINES | |
| Perchlorethylene | xxxx 132 hr. |
| 1,1,1 Trichloroethane | xxxxxxxxxxxxxxxxxxxx 864 hr. |
| Trichlorethylene | xxxxxxxxxxxxxxxxxxxxxxxx 984 hr. |
| 1,1,1 Trichloroethane/Methylene Chloride blend. (35% Methylene Chloride) | xxxxxxxxxxxxxxxxxxxxxxxxxxxxxxxxxxxx1608 hr. |
| SOLVENT with 40% OIL (Vol.) PLUS WATER, ALUMINUM AND IRON FINES | |
| Perchlorethylene | xxx 100 hr. (est.) |
| 1,1,1 Trichloroethane | xxxxxxxxxxxxx 656 hr. |
| Trichlorethylene | xxxxxxxxxxxxxxxxxxxx 816 hr. |
| 1,1,1/Trichloroethane/Methylene Chloride blend. (35% Methylene Chloride) | xxxxxxxxxxxxxxxxxxxx 1056 hr. |
| SOLVENT with 50% OIL (Vol.) PLUS WATER, ALUMINUM AND IRON FINES | |
| Perchlorethylene | xx 72 hr. |
| 1,1,1 Trichloroethane | xxxx 136 hr. |
| Trichloroethylene | xxxxxxxxxxx 552 hr. |
| 1,1,1-Trichloroethane/Methylene Chloride blend. (35% Methylene Chloride) | xxxxxxxxxxxxxxxxxxxxxx 1008 hr. |

To demonstrate the efficacy of the trichlorethylene and methylene chloride solvent, a series of tests were conducted directed to a solvent's acid acceptance value parameter. As is known, the acid acceptance value of a vapor degreasing solvent may be determinative and used to ascertain contamination levels of the solvent thereby indicating need to replace and/or replenish the solvent.

A plurality of solvent samples were prepared having varying proportions of the methylene chloride component of the trichlorethylene-methylene chloride solvent blend. To each of the samples 50 volume percent of oil was added as a contaminant. Each sample was placed in a flask and subjected to boiling point temperatures for a number of hours and their acid acceptance level readings taken. Acid acceptance values were in accordance with ASTM procedure D-2942.

The data obtained from the foregoing tests are summarized in the following Table IV.

TABLE IV

| SOLVENT + 50% Oil Run | % MC | Acid Accept. No. Initial | 24 hrs | 48 hrs | 72 hrs | 96 hrs | 120 hrs | 144 hrs | 168 hrs | 192 hrs | 216 hrs | 240 hrs | 264 hrs | 288 hrs | 312 hrs | 336 hrs | 360 hrs | 384 hrs | 408 hrs |
|---|---|---|---|---|---|---|---|---|---|---|---|---|---|---|---|---|---|---|---|
| 1. | 10 | .1229 | .1229 | .1229 | .1083 | .1083 | .0991 | .0991 | .0918 | .0918 | .0711 | .0711 | .0587 | .0587 | .0587 | .0275 | .0128 | acid---------- | |
| 2. | 20 | .1331 | .1331 | .1331 | .1130 | .1130 | .1038 | .1038 | .0963 | .0963 | .0945 | .0945 | .0908 | .0908 | .0908 | .0871 | .0871 | .0871 | .0648 |
| 3. | 30 | .1366 | .1366 | .1366 | .1141 | .1141 | .1104 | .1104 | .1010 | .1010 | .0992 | .0992 | .0973 | .0973 | .0973 | .0954 | .0954 | .0954 | .0823 |
| 4. | 40 | .1341 | .1341 | .1341 | .1152 | .1152 | .1152 | .1152 | .1133 | .1133 | .1114 | .1114 | .1096 | .1096 | .1096 | .1077 | .1077 | .1077 | .1058 |
| 5. | 50 | .1354 | .1354 | .1354 | .1259 | .1259 | .1259 | .1259 | .1163 | .1163 | .1114 | .1114 | .1125 | .1125 | .1125 | .1106 | .1106 | .1106 | .1087 |
| 6 | 60 | .1349 | .1349 | .1349 | .1175 | .1175 | .1272 | .1272 | .1175 | .1175 | .1156 | .1156 | .1137 | .1137 | .1137 | .1117 | .1117 | .1117 | .1098 |
| 7. | 70 | .1421 | .1421 | .1421 | .1284 | .1284 | .1264 | .1264 | .1187 | .1187 | .1168 | .1168 | .1148 | .1148 | .1148 | .1128 | .1128 | .1128 | .1100 |
| 8. | 80 | .1317 | .1317 | .1317 | .1337 | .1337 | .1297 | .1297 | .1199 | .1199 | .0924 | .0924 | .0609 | (DISCONTINUED DUE TO EQUIP. FAILURE) | | | | | |
| 9. | 90 | .1429 | .1429 | .1429 | .1370 | .1370 | .1311 | .1311 | .1211 | .1211 | .1188 | .1188 | .1169 | .1169 | .1169 | .1149 | .1149 | .1149 | .1129 |
| 10. | 0 | .1315 | .1315 | .0858 | .0858 | .0675 | .0675 | .0675 | .0274 | .0237 | acid---------- | | | | | | | | |
| 11. | MC + 50% | .1555 | .1555 | .1434 | .1434 | .1414 | .1414 | .1414 | .1394 | .1394 | .1394 | .1252 | .1252 | .1252 | .1212 | .1212 | .1212 | .1192 | .1192 |

| SOLVENT + 50% Oil Run | % MC | Acid Accept. No. Initial | 432 hrs | 456 hrs | 480 hrs | 504 hrs | 520 hrs | 552 hrs | 576 hrs | 600 hrs | 624 hrs | 645 hrs | 672 hrs | 696 hrs | 720 hrs | 744 hrs | 768 hrs |
|---|---|---|---|---|---|---|---|---|---|---|---|---|---|---|---|---|---|
| 1. | 10 | .1229 | | | | | | | | | | | | | | | |
| 2. | 20 | .1331 | .0502 | .0502 | acid---------- | | | | | | | | | | | | |
| 3. | 30 | .1336 | .0823 | .0823 | .0748 | .0748 | .0748 | .0542 | .0542 | .0542 | .0281 | .0281 | .0281 | Acid---------- | | | |
| 4. | 40 | .1341 | .1058 | .1058 | .1039 | .1039 | .1039 | .0888 | .0888 | .0888 | .0737 | .0737 | .0737 | Acid---------- | | | |
| 5. | 50 | .1354 | .1087 | .1087 | .1049 | .1049 | .1049 | .0953 | .0953 | .0953 | .0805 | .0805 | .0805 | .0095 | Acid---------- | | |
| 6. | 60 | .1349 | .1098 | .1098 | .1059 | .1059 | .1059 | .0983 | .0983 | .0983 | .0809 | .0809 | .0809 | .1193 | Acid---------- | | |
| 7. | 70 | .1421 | .1109 | .1109 | .1070 | .1070 | .1070 | .0973 | .0973 | .0973 | .0817 | .0817 | .0817 | .0409 | .0233 | Acid-------- | |
| 8. | 80 | .1317 | (DISCONTINUED DUE TO EQUIP. FAILURE) | | | | | | | | | | | | (Acid---------- Estimated) | | |
| 9. | 90 | .1429 | .1129 | .1129 | .1089 | .1089 | .1089 | .1030 | .1030 | .1030 | .0991 | .0991 | .0991 | .0594 | .0416 | .099 | Acid |
| 10. | 0 | .1335 | | | | | | | | | | | | | | | |
| 11. | MC + 50% oil | .1555 | .1192 | .0202 | Acid---------- | | | | | | | | | | | | |

solvent = trichlorethylene
MC = methylene chloride

From Table IV, the synergism of the solvent combinations of the invention become clear. For example, where trichllorethylene alone has a useful life of about 216 hours and methylene chloride alone a useful life of about 480 hours, a blend of the two within certain parameters extends the useful life many more hours to a maximum for some blends of about 744 hours.

Thus, for a solvent blend, as dictated by EPA standards of 20 volume percent trichlorethylene and 80 volume percent methylene chloride, the useful life of the solvent under conventional degreasing conditions would be about 744 hours, extrapolating between runs 7 and 9 of Table IV.

Where cooling is available in the degreasing system and where it is desired to reduce energy input to the degreaser, more methylene chloride may be used and initial boiling point temperatures and sump end operating temperatures determined in accordance with Table V following.

TABLE V

| SOLVENT | VAPOR TEMP °F. | SUMP TEMP °F. | INITIAL B.P. OF SOLVENT BLEND (APPROX) °F. |
|---|---|---|---|
| Tri + 10% MC | 173° | 195° | 175° |
| Tri + 20% MC | 160° | 183° | 163° |
| Tri + 30% MC | 152° | 173° | 153° |
| Tri + 40% MC | 141° | 168° | 148° |
| Tri + 50% MC | 132° | 161° | 141° |
| Tri + 60% MC | 127° | 153° | 133° |
| Tri + 70% MC | 119° | 145° | 125° |
| Tri + 80% MC | 115° | 139° | 119° |
| Tri + 90% MC | 108° | 134° | 114° |
| TRI | 184° | 209° | 189° |
| MC | 106° | 124° | 104° |

Tri = Trichlorethylene
MC = Methylene Chloride

Another series of tests is conducted similar to those described with respect to Tables I, II and III utilizing the solvent blends of trichlorethylene and methylene chloride and similar results obtained to illustrate the efficacy of the solvent blends of the invention.

Thus, there has been disclosed a unique method of carrying out vapor degreasing operations utilizing a solvent blend that has an extended useful life and lower initial boiling point than 1,1,1 trichlorethane or trichlorethylene alone. The resultant solvent blends by reason of lower boiling points require less energy and are more economical than the usual degreasing solvent alone in that lower heat requirements makes for increased fuel efficiency.

While the solvent blends of the invention have been disclosed as comprising about 0.1 volume percent to 90.0 volume percent methylene chloride, those of ordinary skill in the vapor degreasing art will readily appreciate that a solvent blend in accordance with the invention may be selectively formulated to be used most effectively as disclosed hereinbefore. Because of unique operational characteristics of solvent blends, the preferred solvents for use in the selected degreasing method of the invention will be dictated by governmental regulations and the type of vapor degreasing operation being conducted.

While I have described particular embodiments of my invention for purposes of illustration, it is understood that other modifications and variations will occur to those skilled in the art, and the invention accordingly is not to be taken as limited except by the scope of the appended claims. Those of ordinary skill will recognize that the solvent blend of the invention is more economical because gallon for gallon more work product can be vapor degreased than with the unblended vapor degreasing solvents alone.

What is claimed is:

1. In the method of vapor degreasing by contacting a contaminated article with vapors of a solvent consisting essentially of 1,1,1 trichloroethane, the improvement which comprises:

(a) adding a sufficient amount of methylene chloride to the solvent to reduce the initial boiling point of the resultant solvent blend to about 135° F., and (b) continuing vapor degreasing operations with the solvent blend of step (a) at reflux temperatures until the acid acceptance value of the contaminated solvent blend is within the range of about 0.03 to 0.06.

2. The method in accordance with claim 1 which additionally includes the step of:

(c) reclaiming the solvent blend from the contaminated solvent blend and forming the solvent blend of step (a) for reuse.

3. The method in accordance with claim 1 wherein the methylene chloride component of said solvent blend is about 35 volume percent.

4. The method in accordance with claim 3 which includes maintaining a boiling sump zone and additionally includes the steps of collecting and returning condensed solvent blend vapors to the boiling sump zone.

5. The method in accordance with claim 4 which includes the step of compensating for lost solvent by periodically adding additional solvent to said solvent blend to maintain the relative proportions of 1,1,1 trichloroethane to methylene chloride.

6. The method in accordance with claim 5 wherein said solvent blend comprises 65 volume percent 1,1,1 trichloroethane and 35 volume percent methylene chloride and step (b) is conducted until the temperature of the contaminated solvent blend reaches about 172° F.

7. The method of vapor degreasing comprising the steps of:

(a) creating a solvent boiling zone;

(b) forming a solvent blend of about 65 volume percent 1,1,1 trichloroethane and 35 volume percent methylene chloride;

(c) introducing said solvent blend into said boiling zone;

(d) refluxing said solvent blend and removing contaminants therewith by contacting a contaminated article with vapors of the solvent blend in a degreasing zone;

(e) continuing said vapor degreasing and returning solvent and contaminants to said boiling zone until the temperature in said boiling zone is about 172° F.; and (f) discontinuing said degreasing and subjecting the recovered contaminated solvent to a reclamation process.

8. In the method of vapor degreasing by contacting a contaminated article with the vapors of a solvent consisting essentially of trichloroethylene, the improvement which comprises:

(a) adding a sufficient amount of methylene chloride to the solvent to reduce the initial boiling point of the resultant solvent blend to about 120° F.

(b) continuing vapor degreasing operations with the solvent blend of step (a) at reflux temperatures until the acid acceptance value of the contaminated solvent blend is within the range of about 0.03 to 0.06.

9. The method in accordance with claim 8 which additionally includes the step of:

(c) reclaiming the solvent blend from the contaminated solvent blend and forming the solvent blend of step (a) for reuse.

10. The method in accordance with claim 8 wherein the methylene chloride component of said solvent blend exceeds about 20 volume percent.

11. The method in accordance with claim 10 which includes maintaining a boiling sump zone and additionally includes the steps of collecting and returning condensed solvent blend vapors to the boiling sump zone.

12. The method in accordance with claim 11 which includes the step of compensating for lost solvent by periodically adding additional solvent to said solvent blend to maintain the relative proportions of trichlorethylene to methylene chloride.

13. The method in accordance with claim 12 wherein said solvent blend comprises about 20 volume percent trichlorethylene and about 80 volume percent methylene chloride.

14. The method of vapor degreasing comprising the steps of:

(a) creating a solvent boiling zone;

(b) forming a solvent blend consisting essentially of trichloroethylene and about at least 20 volume percent methylene chloride;

(c) introducing said solvent blend into said boiling zone;

(d) refluxing said solvent blend and removing contaminants therewith by contacting a contaminated article with vapors of the solvent blend in a degreasing zone;

(e) continuing said vapor degreasing and returning solvent and contaminants to said boiling zone until the acid acceptance value of the contaminated solvent is within the range of about 0.03 to 0.06, and (f) discontinuing said degreasing and subjecting the recovered contaminated solvent to a reclamation process.

* * * * *